US011175118B1

(12) United States Patent
Manley et al.

(10) Patent No.: US 11,175,118 B1
(45) Date of Patent: Nov. 16, 2021

(54) REAR EJECTION PAYLOAD DISPERSAL PROJECTILE

(71) Applicant: U.S. Government as Represented by the Secretary of the Army, Dover, NJ (US)

(72) Inventors: David Chalfant Manley, Budd Lake, NJ (US); Thomas Michael Presutti, Jr., Long Valley, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/879,329

(22) Filed: May 20, 2020

(51) Int. Cl.

| | |
|---|---|
| ***F42B 12/66*** | (2006.01) |
| ***F41H 13/00*** | (2006.01) |
| ***F42C 9/00*** | (2006.01) |
| ***F42C 13/04*** | (2006.01) |
| ***F41H 11/02*** | (2006.01) |

(52) U.S. Cl.
CPC ..... *F42B 12/66* (2013.01); *F41H 11/02* (2013.01); *F41H 13/0006* (2013.01); *F42C 9/00* (2013.01); *F42C 13/04* (2013.01)

(58) Field of Classification Search
CPC ..... F42B 12/66; F42B 12/36; F42B 12/46; F42B 12/50; F42B 12/56; F41H 13/00; F41H 13/0006; F41H 11/02
USPC ..... 102/504, 505, 502, 357, 477, 499; 89/1.11
See application file for complete search history.

(56) References Cited

U.S. PATENT DOCUMENTS

| | | | | |
|---|---|---|---|---|
| 1,744,233 | A * | 1/1930 | Locori | F42B 12/66 102/504 |
| 3,404,810 | A * | 10/1968 | Beers | F42B 12/50 222/82 |
| 3,741,125 | A * | 6/1973 | La Pointe | F42B 12/70 102/377 |
| 3,851,531 | A | 12/1974 | White | |
| 3,860,199 | A * | 1/1975 | Dunne | F41G 7/266 244/3.13 |
| 5,343,795 | A | 9/1994 | Ziemba | |
| 5,750,918 | A | 5/1998 | Mangolds | |
| 6,576,880 | B2 * | 6/2003 | Martorana | B64C 39/024 244/13 |
| 7,516,700 | B1 * | 4/2009 | Callaway | F42B 4/26 102/334 |
| 8,186,276 | B1 * | 5/2012 | Olden | F42D 5/05 102/504 |

(Continued)

FOREIGN PATENT DOCUMENTS

GB 143281 * 5/1920

*Primary Examiner* — James S Bergin
(74) *Attorney, Agent, or Firm* — John P. DiScala

(57) ABSTRACT

A 40 millimeter (mm) projectile is capable of deploying a payload out of the rear of the projectile. The projectile carries the payload an extended distance from the muzzle and then disperses the payload after a command is provided to the projectile. The projectile includes a proximity fuze which allows it to sense a target and disperse the payload at a given distance from the target. Alternatively, a time-based fuze or radio frequency (RF) based fuze may be employed instead. The payload may be used against a variety of targets, such as personnel, vehicle or aerial targets. In addition, the projectile could be used as a training device for proximity, preprogrammed or RF-controlled fuzed projectiles.

16 Claims, 4 Drawing Sheets

(56) References Cited

U.S. PATENT DOCUMENTS

| | | | | |
|---|---|---|---|---|
| 9,746,295 | B1 * | 8/2017 | Manole | F42B 14/064 |
| 10,197,365 | B1 | 2/2019 | Blyskal | |
| 2019/0346241 | A1 * | 11/2019 | Metz | F41F 3/042 |
| 2020/0003530 | A1 * | 1/2020 | Metz | F42B 10/62 |

* cited by examiner

REAR EJECTION PAYLOAD DISPERSAL PROJECTILE

STATEMENT OF GOVERNMENT INTEREST

The inventions described herein may be manufactured, used and licensed by or for the United States Government.

FIELD OF THE INVENTION

The invention relates in general to munitions and in particular to payload dispersing munitions.

BACKGROUND OF THE INVENTION

It is desirable to be able to carry a payload an extended distance from a weapon system muzzle and then disperse the payload after a command is provided to the projectile. Currently, there is no robust payload dispersal round that is scaled to the 40 millimeter (mm) size. Existing approaches rely on springs and other mechanical devices that are not ideal for storage. In addition, they rely on release mechanisms which are not able to survive high g loads. Finally, current approaches may experience issues related to interaction of the projectile body with the payload.

A need exists for a 40 mm munition which can carry and eject a payload and which does not rely on spring or mechanical mechanisms and which does not experience unintended interaction between the dispersed payload and the munition body.

SUMMARY OF INVENTION

One aspect of the invention is a 40 millimeter rear ejection payload dispersal projectile including an ogive, a midsection, a rear section, a payload containment area, a net payload and a base. The ogive is at a forward end of the projectile and houses a fuze assembly. The midsection is connected to the rear of the ogive and houses a squib. The rear section is connected to the rear of the midsection. The rear section includes an annular protrusion and houses a payload dispersal unit proximate to the squib. The payload dispersal unit is cup-shaped with a base flange and encloses a forward opening of the rear section. The payload containment area is defined by an interior volume of the payload dispersal unit. The payload containment area has a rear opening. The net payload includes a netting partially contained within the payload containment area and a plurality of weights connected to the edge of the netting and extending beyond the payload containment area and abutting the payload dispersal unit. The base is releasably attached to the rear of the rear section by a crimp. The base encloses the rear opening of the payload containment area. Upon initiation by the fuze assembly, the gas generator creates a pressure within the projectile thereby causing the rearward movement of the payload dispersal unit until the base flange contacts the annular protrusion, the rearward movement of the payload dispersal unit causes separation of the base from the rear section thereby deploying the net payload from the rear opening of the payload containment area. Spinning of the net assembly causes the weighted petals to extend the net Embodiments of the invention may include one or more of the following features. The fuze assembly may further include a proximity fuze, a time-based fuze or a radio frequency controlled fuze.

Another aspect of the invention is a projectile comprising an ogive, a midsection, a rear section, a payload containment area and a base. The ogive is at a forward end of the projectile and houses a fuze assembly. The midsection is connected to the rear of the ogive and houses a gas generator. The rear section is connected to the rear of the midsection and houses a payload dispersal unit proximate to the gas generator. The payload dispersal unit encloses a forward opening of the rear section. The payload containment area is defined by an interior volume of the payload dispersal unit. The payload containment area has a rear opening. The base is releasably attached to the rear of the rear section and encloses the rear opening of the payload containment area. Upon initiation by the fuze assembly, the gas generator creates a pressure within the projectile thereby causing the rearward movement of the payload dispersal unit. The rearward movement of the payload dispersal unit causes the separation of the base from the rear section thereby deploying a payload.

Embodiments of the invention may include one or more of the following features. The projectile of may be a 40 mm projectile.

The fuze assembly may further include a proximity fuze which initiates the gas generator upon detecting a target within a predefined proximity. The fuze assembly may alternately include a proximity fuze, a time-based fuze or a radio frequency controlled fuze.

The gas generator may be a squib. The squib produces a pressure in the range of 125-200 pounds per square inch, gauge (PSIG) in a 10 cubic centimeter (cc) volume.

The rear section may further include an annular protrusion extending into an interior volume of the rear section. The payload dispersal unit may be cup-shaped and include a base flange. The annular protrusion may interact with the base flange to restrict movement of the payload dispersal unit within the rear section.

The payload may be a net payload. The net payload may include a netting and a plurality of weights connected to the edge of the netting such that upon deployment, the weights separate due to a centripetal force thereby extending the net.

The base may be releasably attached to the rear of the rear section by a crimp.

Another aspect of the invention is method for deploying a payload from a rear of a projectile comprising the steps of: launching a projectile comprising an ogive housing a fuze assembly, a midsection connected to the rear of the ogive and housing a gas generator, a rear section connected to the rear of the midsection and housing a payload dispersal unit proximate to the gas generator and enclosing a forward opening of the rear section, a payload containment area defined by an interior volume of the payload dispersal unit, the payload containment area having a rear opening, a base releasably attached to the rear of the rear section and enclosing the rear opening of the of payload containment area; activating the fuze assembly; initiating a gas generator upon a precondition being determined by the fuze assembly; translating the payload dispersal unit rearward in response to a pressure caused by the gas generator; detaching the base from the rear section in response to the payload dispersal unit translating rearward; deploying the payload from the rear of the projectile.

Embodiments of the invention may include one or more of the following features. The step of launching the projectile may further include the step of launching the projectile from a 40 millimeter weapon system.

The fuze assembly may comprise a proximity fuze and the step of initiating a gas generator upon a precondition being determined by the fuze assembly may further include the step of initiating a gas generator upon the proximity fuze detecting a target within a predetermined proximity.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A 40 millimeter (mm) projectile is capable of deploying a payload out of the rear of the projectile. The projectile carries the payload an extended distance from the muzzle and then disperses the payload after a command is provided to the projectile. The projectile includes a proximity fuze which allows it to sense a target and disperse the payload at a given distance from the target. Alternatively, a time-based fuze or radio frequency (RF) based fuze may be employed instead. The payload may be used against a variety of targets, such as personnel, vehicle or aerial targets. In addition, the projectile could be used as a training device for proximity, preprogrammed or RF controlled fuzed projectiles.

Advantageously, the projectile ejects the payload from the rear of the projectile. This feature limits negative interactions between the deployed payload and the projectile body. In addition, the projectile is suitable for both storage and high g-loading as it does not rely on spring or other mechanical release mechanisms. Instead, the projectile relies on a low pressure charge to eject the payload. This allows the round to be hand safe.

Figure 1:
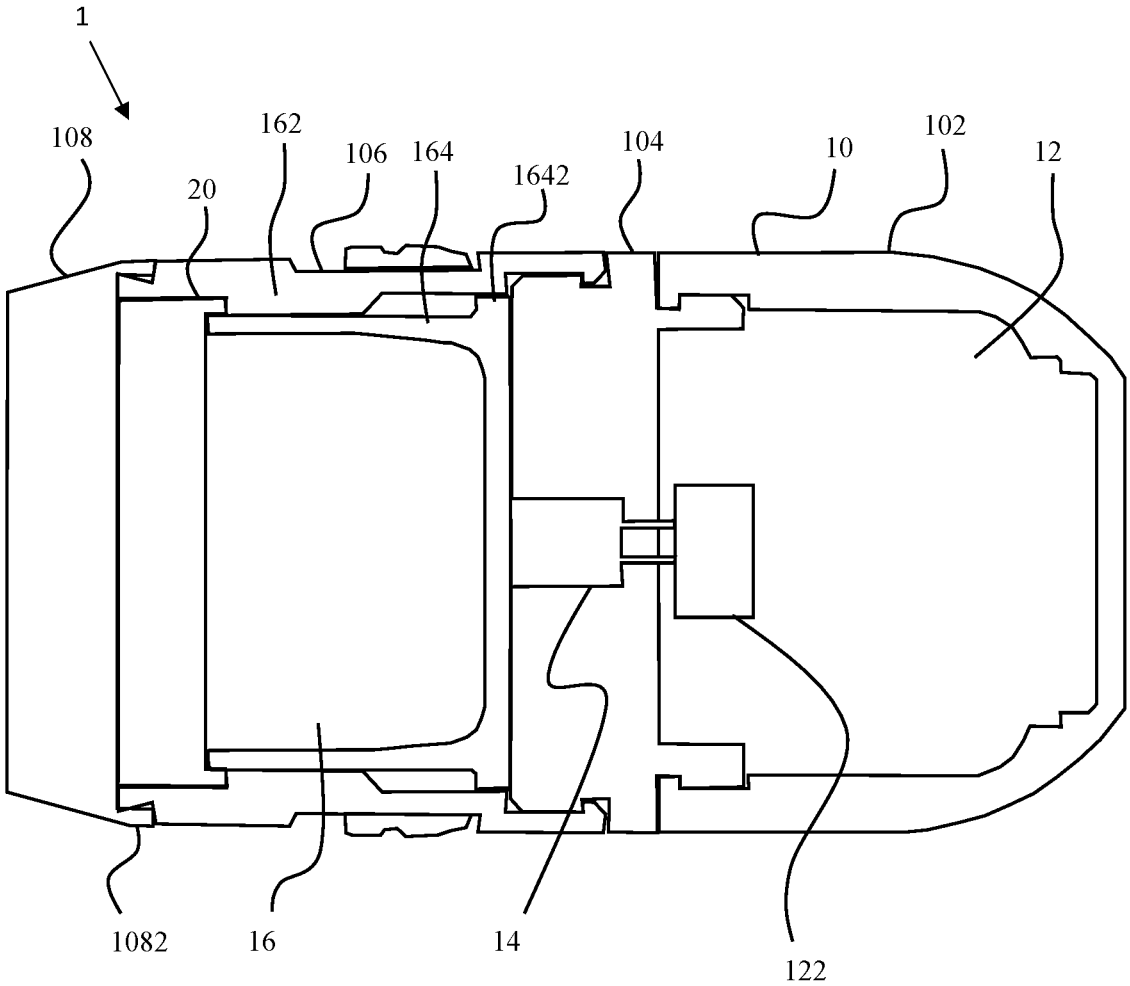
FIG. 1 is a sectional side view of a rear ejection payload dispersal projectile, according to an illustrative embodiment.

FIG. 1 is a sectional side view of a rear ejection payload dispersal projectile, according to an illustrative embodiment. In the embodiment shown, the projectile 1 is a spin stabilized projectile designed to be fired from a 40 mm munition cartridge case through a rifled weapon barrel or tube such as the type fired from a 40 mm grenade launcher. The projectile 1 provides for a rear dispersal mechanism in the relatively small form factor of a 40 mm munition, as compared to traditional cargo rounds, such as cargo carrying mortar rounds. The projectile 1 balances an efficient payload size with the functional components necessary to enable rearward dispersal of the payload. Additionally, the projectile 1 is capable of experiencing setback forces in the magnitude of 40,000 g-forces (g's) on the rear cap of the projectile 1 while still allowing for removal by a relatively small amount of force generated by a squib charge within the projectile 1.

The projectile 1 is not limited to a 40 mm projectile. Further, the projectile 1 is not limited to traditional weapon systems and may be launched from any appropriate tube using a propellant, compressed air, mechanical means or any other propulsion system. In addition, the projectile 1 is not limited to use in weapon system and may be used for non-military purposes including law enforcement and commercial purposes. In other embodiments, the projectile 1 is not fired from a weapon system but rather from a launcher system.

The projectile 1 comprises a projectile body 10, a fuze assembly 12, a squib 14 and a payload containment area 16. The projectile body 10 further comprises an ogive 102, a midsection 104, a rear section 106 and a base 108. The projectile body 10 houses the fuze assembly 12 and squib 14 and defines the payload containment area 16.

The fuze assembly 12 is located in the ogive 102 of the projectile body 10. The fuze assembly 12 may comprise a fuze 122, such as a proximity fuze. In other cases, the fuze assembly 12 comprises a time-based or RF-controlled fuze or some combination of two or more of the three. The fuze 122 initiates a fire command upon a desired condition, such as sensing a target, reaching a pre-determined time or received an RF command. The fuze 122 then initiates a gas generator 14, or squib 14.

The midsection 104 is receivably attached to the rear of the ogive 102. In the embodiment shown, the ogive 102 and midsection 104 are attached via interlocking features on the surfaces of the midsection 104 and ogive 102. The squib 14 is located rear of the fuze assembly 12 within the midsection 104. Upon initiation, the squib 14 creates a pressure inside of the projectile body 10, which as described further below, serves to disperse the payload 20.

In one embodiment, the squib has an output pressure in the range of 125-200 pounds per square inch, gauge (PSIG) in a 10 cubic centimeter (cc) volume. However, in other embodiments, the output pressure may be lower or greater. Alternatively, the gas generator may comprise a component other than a squib, such as a propellant and an electric match. Finally, the force may be provided by mechanical means, such as from a piston actuator.

The midsection 104 is receivably attached to a forward end of the rear section 106. In the embodiment shown, the rear section 106 and midsection 104 are attached via interlocking features on the surfaces of the midsection and rear section. The tail section 106 is a hollow open ended cylinder which defines an interior volume. An annular protrusion 162 formed by a portion of the rear section 106 having a stepped down inner diameter extends within the interior volume. As will be discussed below, in alternate embodiments in which there is no payload containment area, the rear section 106 does not comprises the annular protrusion 162.

A payload dispersal unit 164 is housed within the rear section 106 proximate to the midsection 104 and squib 14 and encloses the forward opening of the rear section 106. The payload dispersal unit 164 is cup-shaped with a base flange 1642. The payload dispersal unit 164 is concentric with the rear section 106 and the interaction of the base flange 1642 with a front surface of the annular protrusion 162 restricts movement of the payload dispersal unit 164 within the rear section 106 to a set distance. The hollow interior of the payload dispersal unit 164 defines a payload containment area 16 which may contain all of or a portion of a payload 20. The payload containment area 16 is accessible through a rear opening.

In an alternate embodiment, the payload dispersal unit 164 may deploy with the payload 20 or there may be no payload dispersal unit 164. The interior volume of the rear section 106 may function as the payload containment area 16 with the payload 20 housed within the rear section 106 proximate to the midsection 104 and squib 14 and encloses the forward opening of the rear section 106.

The payload containment area 16 houses the payload 20 of the projectile 1. In the embodiment shown, the payload 20 is a net assembly comprising a net attached to weighted petals for disabling a rotary or propeller driven device. However, the payload 20 is not limited to a net assembly. The payload containment area 16 may contain any payload 20 which may fit within its volume and is suitable for being dispersed from a projectile 1. For example, the payload containment area 16 may contain obscurants, powder or liquid deterrents/malodorants, an unmanned aerial vehicle, pellets, fibers, streamers, illuminant, flash mix for training and any other payload which fits the volume.

In the embodiment shown, the weighted petals for enabling the spread of the net are located rear of the payload dispersal unit 164 and in contact with a rear surface of the payload dispersal unit 164. However, in other embodiments, the payload dispersal unit 164 may extend fully to the rear of the midsection 104. During flight, at a suitable point from the target, the projectile disperses the net assembly 20. The net assembly 20 is spinning upon ejection due to the spinning of the projectile 1. The weighted petals spread out the still spinning net to fully deploy the net.

The base 108 of the projectile body 10 is attached to the rear of the rear section 106 and encloses the payload containment area 16. By employing a rear deployment scheme, the base connection may be of a relatively low force which is able to survive gun launch. For example, in embodiments, it may be pried off by hand. This is due to the fact that the propellant gases of gun launch act on the back of the base thereby creating a larger force forward on the base than the setback force of the internal payload. As a result, the connection is able to be very light while still surviving launch. This then allows the projectile to employ a relatively very low pressure squib to eject the payload, which makes the round, hand safe. The ejection force is so low that it is safe to the user and has no effect when the projectile is crimped into the case in cartridge form.

In one embodiment, the base 108 comprises an extension 1082 which is crimped onto the rear section 106. However, the base 108 may be attached by other means in other embodiments provided that the attachment remains integral during operation until overcome by the pressures generated by the squib 14. For example, the base 108 may be attached by threads, adhesive, snap fits or press fits.

Figure 2:
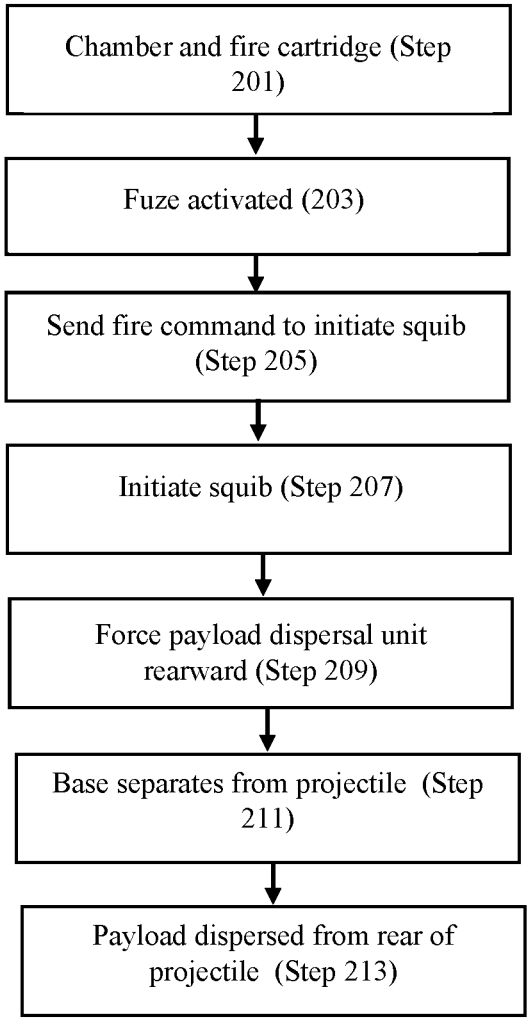
FIG. 2 is a flowchart illustrating a method for ejecting a payload from a projectile, according to one illustrative embodiment.

FIG. 2 is a flowchart illustrating a method for ejecting a payload from a projectile, according to one illustrative embodiment. FIGS. 3A-3D illustrate the rear ejection payload dispersal projectile in various states of operation, according to an illustrative embodiment.

Figure 3A:
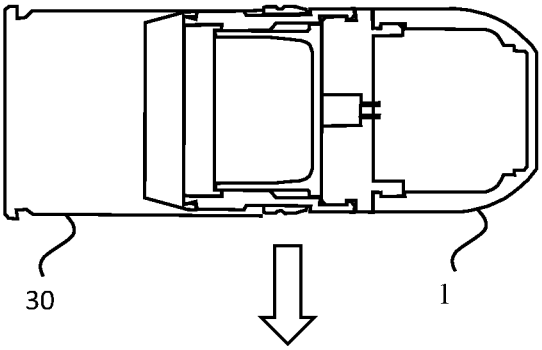
FIG. 3A is a sectional side view of the projectile in a cartridged state of operation, according to an illustrative embodiment.

In step 301, a cartridge comprising the projectile 1 is chambered within the weapon system and fired. FIG. 3A is a sectional side view of the projectile 1 in a cartridged state of operation, according to an illustrative embodiment. The projectile 1 is ejected from the cartridge and propelled from the weapon system.

Figure 3B:
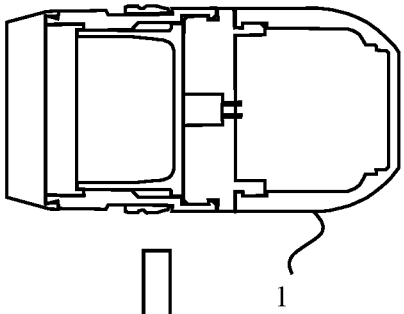
FIG. 3B is a sectional side view of the projectile in a fired state of operation, according to an illustrative embodiment.

In step 303, the fuze 122 is activated. During launch the fuze 122 is activated and functions while in flight. For example, a proximity-based fuze 122 will begin searching for targets within a given proximity. A time-based fuze 122 will set a counter or an RF-controlled fuze 122 will listen for commands. FIG. 3B is a sectional side view of the projectile 1 in a fired state of operation, according to an illustrative embodiment.

In step 305, the fuze sends a fire command to initiate the squib 14 upon the precondition being met. For example, depending on the type of fuze 122 employed, the precondition may be a target being sensed within a defined proximity, a set time after launch being reached or an RF command being received.

In step 307, the squib 14 is initiated. Upon initiation, the squib 14 creates a pressure inside of the projectile body 10.

Figure 3C:
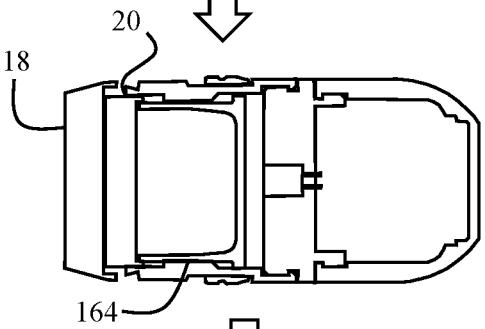
FIG. 3C is a sectional side view of the projectile in an initiated state of operation, according to an illustrative embodiment.

In step 309, the payload dispersal unit 164 is forced rearward by the pressure. FIG. 3C is a sectional side view of the projectile 1 in an initiated state of operation, according to an illustrative embodiment. As the pressure increases within the projectile 1, the payload dispersal unit 164 is pushed acts as a piston and is pushed toward the rear of the projectile 1. The proximity of the payload dispersal unit 164 to the squib allows for a minimal pressure generation to move the payload dispersal unit 164. The payload dispersal unit 164 is limited in the distance that it can travel rearward as the base flange contacts the annular protrusion 162 of the rear section 106.

In alternative embodiments not comprising a base flange 1642 or annular protrusion 162, the payload dispersal unit 164 is not limited in the distance that it can travel. In these embodiments, the payload dispersal unit 164 is ejected with the payload 20.

In yet another embodiment, in which there is no payload dispersal unit 164, the payload 20, itself, is forced rearward by the pressure and acts as a piston to remove the base 108.

Figure 3D:
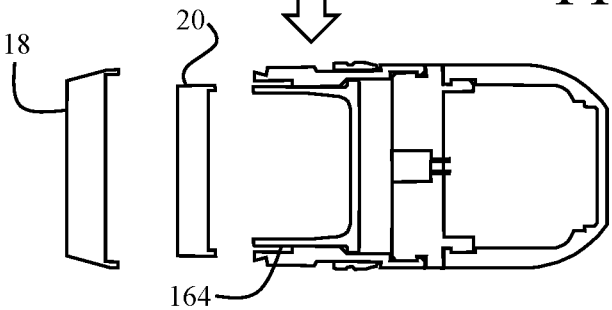
FIG. 3D is a sectional side view of the projectile in a separated state of operation, according to an illustrative embodiment.

In step 311, the base 108 separates from the projectile 1. FIG. 3D is a sectional side view of the projectile 1 in a separated state of operation, according to an illustrative embodiment. As the payload dispersal unit 164 moves rearward it contacts the payload 20 and pushes the payload 20 rearward. The payload 20 in turn contacts the base 108 and pushes the base 108 rearward. The connection between the base 108 and the rear section 106 is overcome by the force caused by the squib pressure and the base 108 separates from the projectile 1.

In embodiments in which the payload dispersal unit 164 extends the length of the rear section 106, the payload dispersal unit 164 itself may directly push against the base 108 to separate the base 108.

In step 313, the payload 20 is ejected from the rear of the payload containment area 16 as the projectile 1 continues to travel along its flight path. As the payload 20 is ejected from the rear and the projectile 1 continues forward, the projectile body 10 does not interfere with the payload 20 upon ejection.

Figure 4:
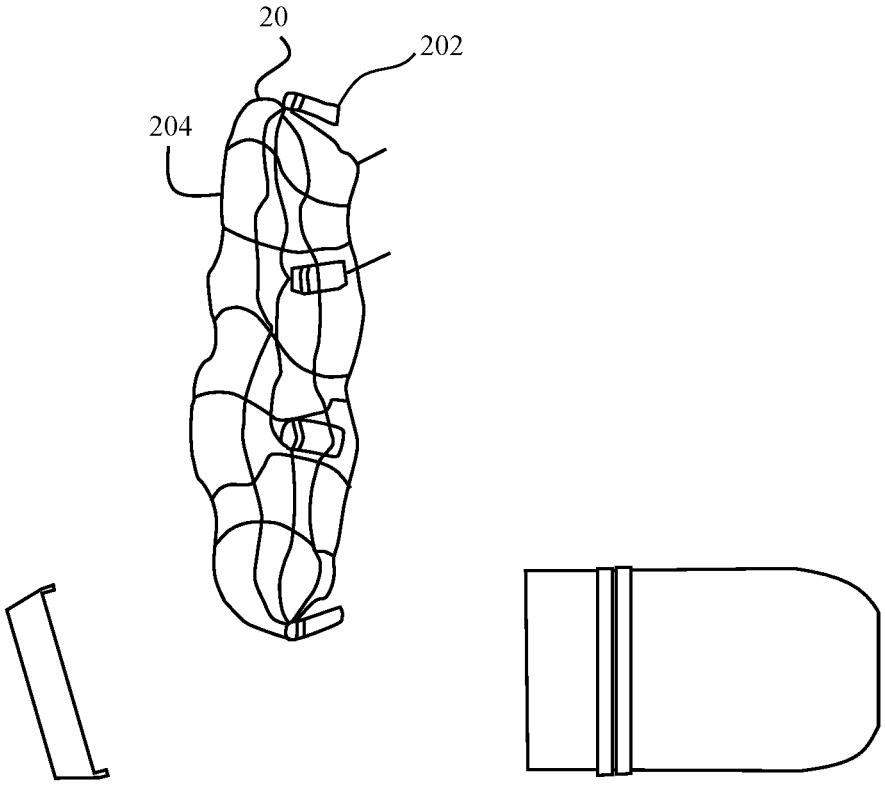
FIG. 4 is a side view of a rear ejection payload dispersal projectile dispersing a net assembly, according to an illustrative embodiment.

FIG. 4 is a side view of a rear ejection payload dispersal projectile dispersing a net assembly, according to an illustrative embodiment. In this embodiment, the projectile 1 disperses the net assembly 20. The net assembly 20 is spinning upon ejection due to the spinning of the projectile 1. The weighted petals 202 spread out the still spinning net 204 to fully deploy the net 204 thereby allowing the netting to ensnare a nearby rotary or propeller driven device.

While the invention has been described with reference to certain embodiments, numerous changes, alterations and modifications to the described embodiments are possible without departing from the spirit and scope of the invention as defined in the appended claims, and equivalents thereof.

What is claimed is:

1. A 40 millimeter rear ejection payload dispersal projectile comprising:

an ogive at a forward end of the projectile housing a fuze assembly;

a midsection connected to a rear of the ogive and housing a squib charge;

a rear section connected to a rear of the midsection, the rear section comprising an annular protrusion and housing a payload dispersal unit proximate to the squib charge, the payload dispersal unit being cup-shaped with a base flange and enclosing a forward opening of the rear section;

a payload containment area defined by an interior volume of the payload dispersal unit, the payload containment area having a rear opening;

a net assembly comprising a net partially contained within the payload containment area and a plurality of weighted petals connected to an edge of the net and extending beyond the payload containment area and abutting the payload dispersal unit;

a base releasably attached to a rear of the rear section by a crimp and enclosing the rear opening of the payload containment area;

wherein upon initiation by the fuze assembly, the squib charge creates a pressure within the projectile thereby causing a rearward movement of the payload dispersal unit until the base flange contacts the annular protrusion, the rearward movement of the payload dispersal unit causes separation of the base from the rear section thereby deploying the net assembly from the rear opening of the payload containment area wherein spinning of the net assembly causes the weighted petals to extend the net.

2. The projectile of claim 1 wherein the fuze assembly further comprises a fuze selected from the group consisting of: proximity fuze, a time-based fuze and a radio frequency controlled fuze.

3. The projectile of claim 1 wherein the squib produces a pressure in a range of 125-200 pounds per square inch, gauge in a 10 cubic centimeter volume.

4. A projectile comprising:

an ogive at a forward end of the projectile housing a fuze assembly;

a midsection connected to a rear of the ogive and housing a gas generator;

a rear section connected to a rear of the midsection and housing a payload dispersal unit proximate to the gas generator and enclosing a forward opening of the rear section;

a payload containment area defined by an interior volume of the payload dispersal unit, the payload containment area having a rear opening;

a base releasably attached to a rear of the rear section and enclosing the rear opening of the payload containment area;

wherein upon initiation by the fuze assembly, the gas generator creates a pressure within the projectile thereby causing a rearward movement of the payload dispersal unit, the rearward movement of the payload dispersal unit causing a separation of the base from the rear section thereby deploying a net assembly.

5. The projectile of claim 4 wherein the projectile is a 40 mm projectile.

6. The projectile of claim 4 wherein the fuze assembly further comprises a proximity fuze which initiates the gas generator upon detecting a target within a predefined proximity.

7. The projectile of claim 4 wherein the fuze assembly further comprises a fuze selected from the group consisting of: proximity fuze, a time-based fuze and a radio frequency controlled fuze.

8. The projectile of claim 4 wherein the gas generator is a squib.

9. The projectile of claim 8 wherein the squib produces a pressure in a range of 125-200 pounds per square inch, gauge in a 10 cubic centimeter volume.

10. The projectile of claim 4 wherein the rear section further comprises an annular protrusion extending into an interior volume of the rear section and the payload dispersal unit is cup-shaped and comprises a base flange wherein said annular protrusion interacts with the base flange to restrict movement of the payload dispersal unit within the rear section.

11. The projectile of claim 4 wherein the net assembly comprises a net and a plurality of weighted petals connected to an edge of the net such that upon deployment, the weighted petals separate due to a spin of the projectile thereby extending the net.

12. The projectile of claim 4 wherein the base is releasably attached to a rear of the rear section by a crimp.

13. A method for deploying a payload from a rear of a projectile comprising the steps of:

launching a projectile comprising an ogive housing a fuze assembly, a midsection connected to a rear of the ogive and housing a gas generator, a rear section connected to a rear of the midsection and housing a payload dispersal unit proximate to the gas generator and enclosing a forward opening of the rear section, a payload containment area containing a spinning net assembly and defined by an interior volume of the payload dispersal unit, the payload containment area having a rear opening, a base releasably attached to a rear of the rear section and enclosing the rear opening of the of payload containment area;

activating the fuze assembly;

initiating a gas generator upon a precondition being determined by the fuze assembly;

translating the payload dispersal unit rearward in response to a pressure caused by the gas generator;

detaching the base from the rear section in response to the payload dispersal unit translating rearward; and deploying the spinning net assembly from a rear of the projectile, wherein one or more weighted petals of the spinning net assembly cause a net of the net assembly to extend.

14. The method of claim 13 wherein the step of launching the projectile further comprises the step of launching the projectile from a 40 millimeter weapon system.

15. The method of claim 13 wherein the fuze assembly comprises a proximity fuze and the step of initiating the gas generator upon a precondition being determined by the fuze assembly further comprises initiating the gas generator upon the proximity fuze detecting a target within a predetermined proximity.

16. The method of claim 13 wherein the step of initiating the gas generator upon a precondition being determined by the fuze assembly further comprises the step of initiating a squib charge having a pressure in a range of 125-200 pounds per square inch, gauge in a 10 cubic centimeter volume upon a precondition being determined by the fuze assembly.

* * * * *